United States Patent [19]

Pfalzer

[11] Patent Number: 4,724,075

[45] Date of Patent: Feb. 9, 1988

[54] FLOTATION TANK

[75] Inventor: Lothar Pfalzer, Heidenheim, Fed. Rep. of Germany

[73] Assignee: J.M. Voith GmbH, Heidenheim, Fed. Rep. of Germany

[21] Appl. No.: 885,001

[22] Filed: Jul. 14, 1986

[30] Foreign Application Priority Data

Jul. 25, 1985 [DE] Fed. Rep. of Germany ..... 3526576

[51] Int. Cl.[4] ..... B03D 1/24

[52] U.S. Cl. ..... 210/221.2; 209/167; 210/525; 210/538

[58] Field of Search ..... 210/221.1, 221.2, 198.1, 210/205–208, 513, 525, 538; 209/162–167, 172.5, 173–178

[56] References Cited

U.S. PATENT DOCUMENTS 4,162,972 7/1979 Green ..... 210/221.2

4,470,903 9/1984 van Leeuwen ..... 210/221.2

*Primary Examiner*—Frank Sever

*Attorney, Agent, or Firm*—Jeffers, Hoffman & Niewyk

[57] ABSTRACT

A flotation tank which is elongate and is divided along its length into individual compartments. Injectors (2) for each compartment are connected laterally to the tank (1) approximately 30 cm to 50 cm below the surface of the suspension so that the suspension flows out in a forward direction towards the outlet end and scum removal trough (3) of the flotation tank (1). The injectors are preferably connected both at their inlet side and their outlet side to the same compartment. The removal of scum is preferably effected by means of cyclones which are provided in a vertical arrangement at the outlet end of the flotation tank.

6 Claims, 2 Drawing Figures

1
2
3
4
5
6
7
8
10
11
12
13

FLOTATION TANK

BACKGROUND OF THE INVENTION

This invention relates to a flotation apparatus for removing dirt particles and scum from a suspension. More particularly, this invention relates to a flotation apparatus comprising an elongate tank which has successive compartments arranged in the longitudinal direction of the tank to form individual flotation cells, and to which a suspension is supplied which is mixed with air via at least one injector per cell.

An apparatus of this general type is described in U.S. Pat. No. 4,220,612. In this prior art flotation apparatus, the partitions are extended far above the level of the suspension and the injectors are connected to the individual compartments on the outlet side only. Inside the flotation tank, the flow of the suspension proceeds from compartment to compartment through apertures located in the base of the partitions. The suspension is partially removed at the outlet end and is then returned to the individual injectors. The flow of suspension in this prior art apparatus is subject to very unfavorable conditions as regards the elimination of gas bubbles to which the particles of dirt which are present in the suspension have become attached. Each compartment, therefore, needs at least one scum paddle and its own scum removal trough for the removal of scum. Consequently, such prior art apparatus is relatively costly while retaining the disadvantage of unfavorable flotation conditions.

SUMMARY OF THE INVENTION

The object of the present invention is to provide a flotation apparatus in which as few components as possible are required, so that the overall design of the flotation tank is very simple. Additionally, it is desired to provide a flotation apparatus in which favorable conditions of flow are established both for the flotation of the particles of dirt and for the removal of scum.

The present invention, in one form thereof, provides an elongated flotation tank which is divided along its length into individual compartments. The compartments are formed by partitions which extend upwardly from the bottom of the tank but which end about 30 cm maximum below the surface of the suspension. Each compartment includes at least one injector which is connected to the lateral sides of the tank with the outlet aperture of the injector located approximately 30 cm to 50 cm below the surface of the suspension. The suspension flows in a forward direction toward the outlet end of the tank where the scum is removed from the tank. The injectors are preferably connected both at their inlet side and their outlet side to the same compartment. The removal of scum is effected by means of cyclones which are vertically arranged at the outlet end of the flotation tank.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresonding parts throughout the several views of the drawings.

Figures 1, 2:
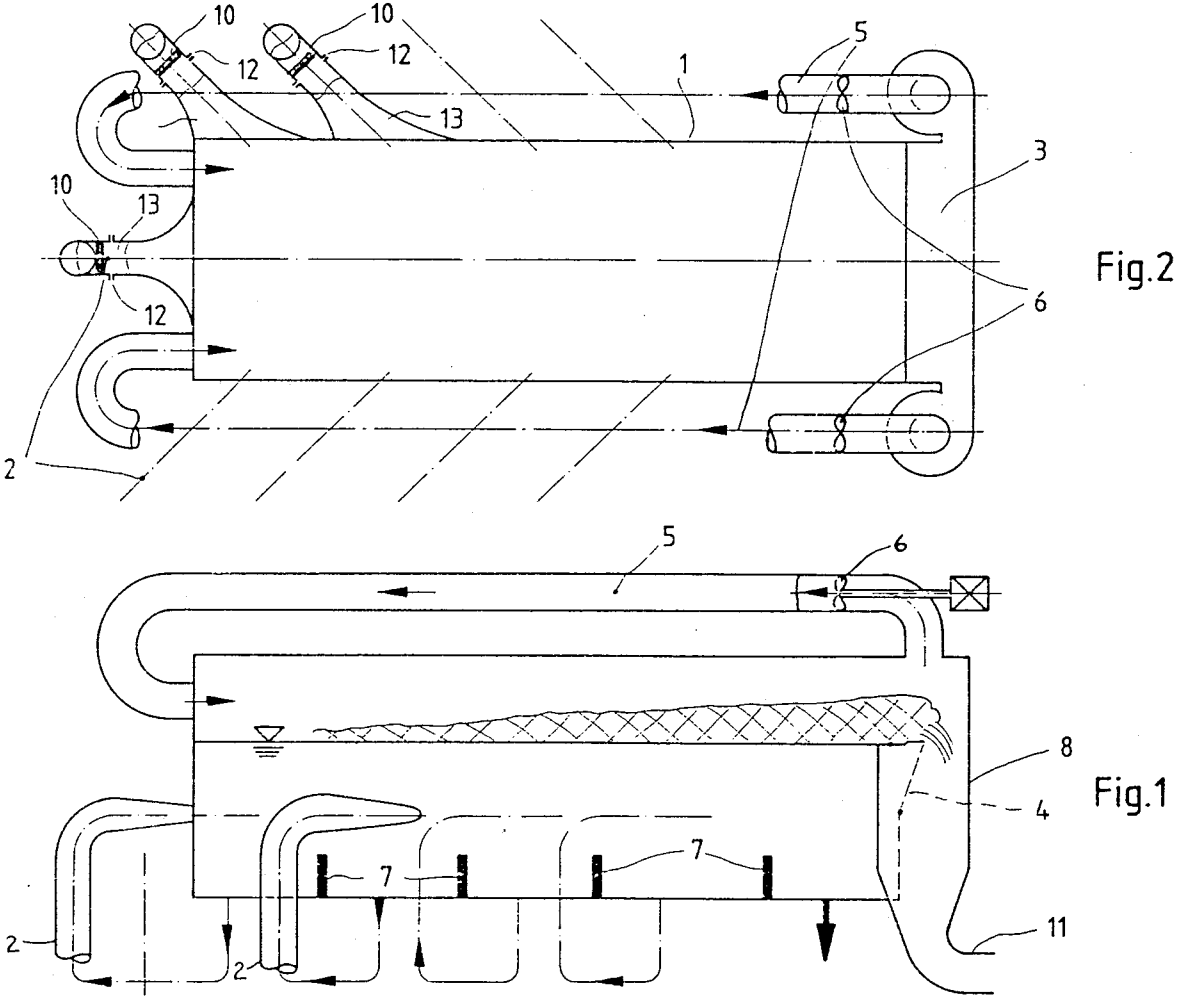
FIG. 1 shows a diagrammatic cross sectional view of a flotation apparatus according to the present invention.
FIG. 2 shows a plan view of the flotation apparatus of FIG. 1.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Referring to FIGS. 1 and 2, the injectors are designated by 2, the scum removal trough provided at the outlet end of the flotation tank by 3, the cyclone by 8 and the air return lines by 5. The large flotation tank 1 is divided into cells or compartments by means of partitions 7, which extend upwardly to 30 cm maximum below the surface of the suspension, and the suspension is supplied to the said cells via injectors 2. At the same time, injectors 2 are connected laterally to the compartments of the flotation tank 1 with their inlet sides substantially at the level of the floor of the flotation tank. The outlet pressure and inlet aperture of each injector are connected substantially to the same region of the tank side which defines a sidewall of a compartment. At the same time, the injector outlet apertures lie within a range of between 30 cm and 70 cm, preferably between 30 cm and 50 cm, below the surface of the suspension. The injectors 2 are connected so that the suspension flows in a direction which slopes toward the outlet end and the scum trough 3 of the flotation tank 1. As a result, the suspension travels serially from compartment to compartment and the delivery of scum toward the outlet end of the flotation tank 1 is substantially assisted thereby. From the scum trough 3 the scum reaches a cyclone 8 which is positioned substantially vertically and which is provided on both lateral sides of the flotation tank 1. At the outlet side, there is connected to the upper end of each cyclone 8 respectively an air return line 5 into which there is also incorporated a fan 6. Fan 6 draws in the air and scum and forces the air into the respective air return line 5.

The flotation tank 1 is designed as a substantially closed reservoir which may be constructed as a horizontal cylinder of circular cross section.

As shown in FIG. 1, the injector(s) 2 of the first compartment may, of course, be connected at the front side to the flotation tank 1. An adjustable dam 4 is indicated in broken lines with which the suspension level may be varied somewhat. The soil content of the scum is extracted via outlet 11 by means of a conventional soil pump. The accept is removed from the last compartment at the base of the flotation cell, as shown by the arrow.

To assist in the removal of scum, there could also be provided an additional central scum removal trough 3', as shown in FIG. 2 in dash, double dot lines.

The injectors are preferably provided with diaphragms 10 followed by a mixing section 13 which becomes progressively flatter in the vertical direction. The air is sucked from the suspension flow into mixing section 13 through air intake apertures 12 situated a short distance or immediately behind the diaphragms.

What is claimed is:

1. A flotation apparatus for a suspension having a suspension surface, said apparatus comprising:

an elongate tank with a floor, an oulet end and longitudinal walls;

means providing an alternative to scum paddles and scum removal troughs in each of the cells of said apparatus, including, means for providing suspension flow in a forwardly sloping direction, for removing scum therefrom and increasing flotation of said scum from said suspension;

said means including a plurality of partitions upwardly extending from said floor to at least 30 cm below the suspension surface, said partitions defining individual flotation cells therebetween, at least one injector with an outlet aperture for each of said flotation cells, which injectors are provided for mixing air with said suspension, for minimizing suspension particulates at said floor, said at least one injector connected substantially horizontally at a lateral position of said longitudinal walls;

said flotation cell injectors, which are positioned between 30 cm and 70 cm below said suspension surface, cooperating with said partitions to provide suspension flow toward said outlet end of said tank for removal of said scum.

2. A flotation apparatus according to claim 1, characterized in that the flotation tank comprises a substantially closed, horizontal tank of circular cross section.

3. A flotation apparatus according to claim 1, characterized in that at least one cyclone (8) with an outlet is arranged substantially vertically at the outlet end of the tank (1) for removal of scum, said tank having a front end, a return line connected between said cyclone outlet and said front end, and a fan (6) connected to the outlet of said at least one cyclone for conveying air via the return line from the cyclone outlet to the front end of the flotation tank (1).

4. A flotation apparatus according to claim 1, characterized in that each of said injectors has both an inlet aperture and an outlet aperture, which inlet and outlet apertures of each of said injectors (2) are connected to the walls of said tank in substantially the region of the same cell.

5. A flotation apparatus according to claim 1, characterized in that each therefor said injectors (2) includes a diaphragm (10) and a mixing section (13) connected downstream of said diaphragm, said injectors further having air intakes including outlet apertures (12) situated a short distance behind said diaphragm for sucking the air through the suspension flow.

6. A flotation apparatus for a suspension having a suspension surface, said apparatus comprising:

an elongate tank with a floor, an oulet end and longitudinal walls;

means providing an alternative to scum paddles and scum removal troughs in each of the cells of said apparatus, including, means for providing suspension flow in a forwardly sloping direction for removing scum therefrom, increasing flotation of said scum from said suspension flotation of said scum from said suspension;

said means including a plurality of partitions upwardly extending from said floor to at least 30 cm below the suspension surface, said partitions defining individual flotation cells therebetween, at least one injector with an outlet aperture for each of said flotation cells, which injectors are provided for mixing air with said suspension, for minimizing suspension particulates at said floor, said at least one injector connected substantially horizontally at a lateral position of said longitudinal walls;

said flotation cell injectors, which are positioned between 30 cm and 70 cm below said suspension surface, cooperating with said partitions to provide suspension flow toward said outlet end of said tank for removal of said scum.

* * * * *

UNITED STATES PATENT AND TRADEMARK OFFICE

CERTIFICATE OF CORRECTION

PATENT NO. : 4,724,075

DATED : February 9, 1988

INVENTOR(S) : Lothar Pfalzer

It is certified that error appears in the above-identified patent and that said Letters Patent is hereby corrected as shown below:

Col. 2, line 28, change "pressure" to --aperture--;
Claim 1, Col. 3, line 4, change "oulet" to --outlet--;
Claim 5, Col. 4, line 8, change "therefor" to --of--;
Claim 6, Col. 4, line 16, change "oulet" to --outlet--;
Claim 6, Col. 4, line 24, delete "flotation of said scum from said suspension".

Signed and Sealed this

Ninth Day of August, 1988

*Attest:*

*Attesting Officer*

DONALD J. QUIGG

*Commissioner of Patents and Trademarks*